US008077008B2

(12) United States Patent
McLoughlin

(10) Patent No.: US 8,077,008 B2
(45) Date of Patent: Dec. 13, 2011

(54) VARISTOR AND PRODUCTION METHOD

(75) Inventor: Neil McLoughlin, Blackrock (IE)

(73) Assignee: Littlefuse, Inc., Des Plaines, IL (US)

( * ) Notice: Subject to any disclaimer, the term of this patent is extended or adjusted under 35 U.S.C. 154(b) by 85 days.

(21) Appl. No.: 12/478,529

(22) Filed: Jun. 4, 2009

(65) Prior Publication Data

US 2010/0085143 A1 Apr. 8, 2010

Related U.S. Application Data

(62) Division of application No. 11/551,131, filed on Oct. 19, 2006, now abandoned.

(60) Provisional application No. 60/729,151, filed on Oct. 20, 2005.

(51) Int. Cl.
*H01C 7/10* (2006.01)

(52) U.S. Cl. ..... 338/20; 338/21

(58) Field of Classification Search ..... 338/20, 338/21, 275

See application file for complete search history.

(56) References Cited

U.S. PATENT DOCUMENTS 4,212,045 A * 7/1980 Martzloff ..... 361/127
4,371,860 A * 2/1983 May et al. ..... 338/21
4,975,674 A * 12/1990 Sumiyoshi et al. ..... 338/21

* cited by examiner

*Primary Examiner* — Kyung Lee
(74) *Attorney, Agent, or Firm* — Kacvinsky Daisak, PLLC

(57) ABSTRACT

A varistor has a disc of ceramic material having opposed faces with face edges. There is an electrode on each face with a gap between each electrode and the edge of the face. Glass passivation is on at least one face in the gap, the passivation not extending from one electrode to the other electrode around the surface of the disc. Because the passivation is only on the planar opposed disc faces, it may be applied in a simple operation such as screen printing. Indeed, the screen printing may be performed while the discs are in the same nest plates as are used for printing of electrode paste. Even though the passivation does not extend from one electrode to the other, it nevertheless breaks a potentially conductive path between the electrodes caused by interaction between the ceramic and encapsulant materials.

7 Claims, 2 Drawing Sheets

VARISTOR AND PRODUCTION METHOD

PRIORITY CLAIM

This application is a non-provisional of, and claims priority to and the benefit of, U.S. Provisional Patent Application Ser. No. 60/729,151, filed Oct. 20, 2005, which claims priority to Ireland Patent Application IE2005/0701, filed Oct. 19, 2005.

BACKGROUND

The disclosed system relates to metal oxide varistors (MOVs).

Manufacture of a MOV typically involves sintering metal oxide ceramic powder to provide a disc (may also be square or other shapes) body, firing electrodes onto the disc body, attaching leads typically by means of soldering and encapsulating. However it is well known that the choice of encapsulant is critical to ensure good electrical stability over time. It has been found that most standard encapsulation materials will lead to increased leakage and or a drop in the nominal voltage when subject to a biased elevated temperature test, typically called an Accelerated Life Test, e.g. 125° C., at rated bias voltage for 1000 hours.

A conventional approach to addressing this problem is to develop or select a specific material which does not exhibit this problem. Another approach is to apply a passivation material to the exposed surface of the MOV unit to prevent the surface interaction. Developing a custom ensapsulant material is time-consuming and typically results in a non-standard material with associated impact on unit cost. For high volume products, a custom enscapsulant is a suitable approach. However this may not suit low volume products. Therefore, many suppliers take the approach of applying a passivation material to the exposed MOV surface.

Applying a passivation material requires a separate step in the manufacturing process, and it is often difficult to achieve good uniformity of the passivation material coverage.

The disclosed system is therefore directed towards providing an improved method of preventing encapsulant/ceramic interaction from causing faults.

SUMMARY

According to the disclosed system, there is provided a method of producing a varistor having electrodes on opposed disc or body faces, the method comprising the steps of providing a passivation material between a ceramic material and an encapsulant, the passivation material not extending from one electrode to the other.

In one embodiment, the passivation material is applied in a band adjoining at least one of the electrodes around its periphery.

In another embodiment, the passivation material is applied as a band around each electrode.

In a further embodiment, the passivation material comprises glass paste.

In one embodiment, the passivation material is printed onto the disc faces.

In another embodiment, the discs are supported during printing in nest plates.

In a further embodiment, the discs are supported in the same nest plates as are used during printing of the electrodes.

In one embodiment, the disc is stacked with at least one other disc.

In another embodiment, the passivation material has a depth to ensure avoidance of contact between a terminal and ceramic of a disc in proximity to the terminal.

In another aspect, the disclosed system provides a varistor comprising:

- a disc or body of ceramic material and electrodes on opposed faces of the disc;
- encapsulatant surrounding the disc and electrodes; and
- a passivation material on the disc, the passivation material not extending from one electrode to the other.

In one embodiment, the passivation material is in a band adjoining at least one of the electrodes.

In another embodiment, the band is on at least one of the opposed disc faces.

Additional features and advantages are described herein, and will be apparent from, the following Detailed Description and the figures.

BRIEF DESCRIPTION OF THE FIGURES

The disclosed system will be more clearly understood from the following description of some embodiments thereof, given by way of example only with reference to the accompanying drawings in which.

DETAILED DESCRIPTION

Figure 1:
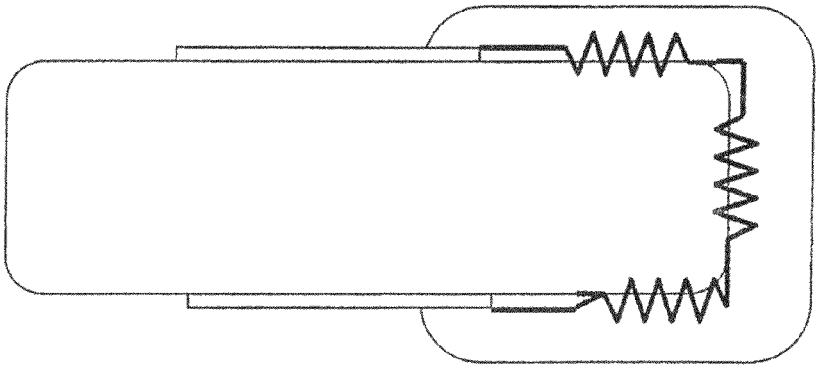
FIG. 1 is a diagram showing a theory behind a passivation method of the disclosed system.

Referring to FIG. 1, the problem set out above is that there is effectively a resistive surface link, created from the interaction of the encapsulant and the exposed MOV surface from the top electrode radially out, then down the disc body edge, and then radially in to the other electrode, when subjected to an accelerated life test whose purpose is to demonstrate the electrical stability over time.

Figure 2:
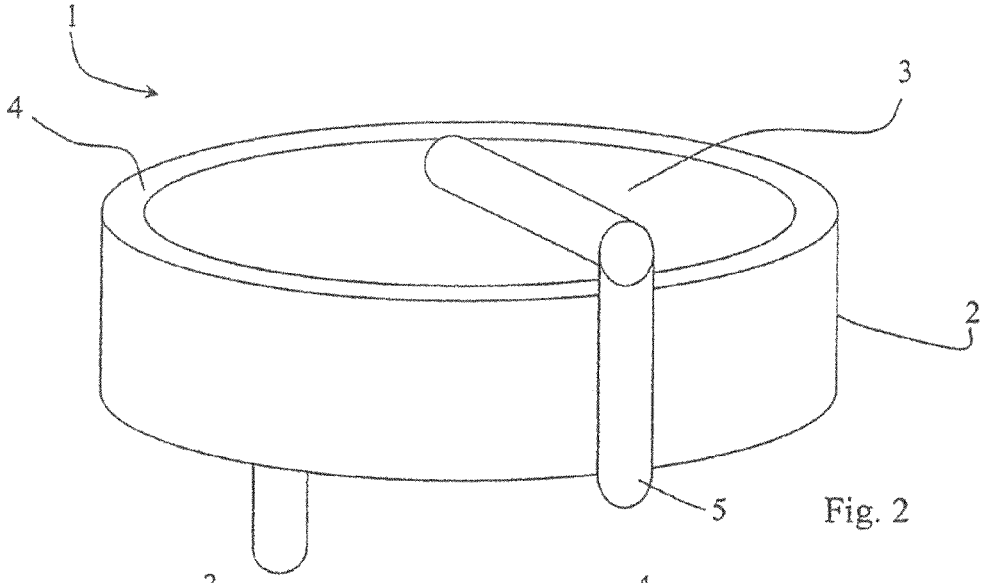
FIG. 2 is a perspective diagram of a passivated disc with leads, before encapsulation.

Referring to FIG. 2, a varistor disc 1 comprises a ceramic body 2 and top and bottom electrodes 3. The ring-shaped planar surfaces of the body 2 which are not covered by the electrodes 3 are passivated with a passivation material 4. The passivation method can be screen printing or transfer printing or other masking/deposition methods. Leads 5 are shown in this drawing.

Figure 3:
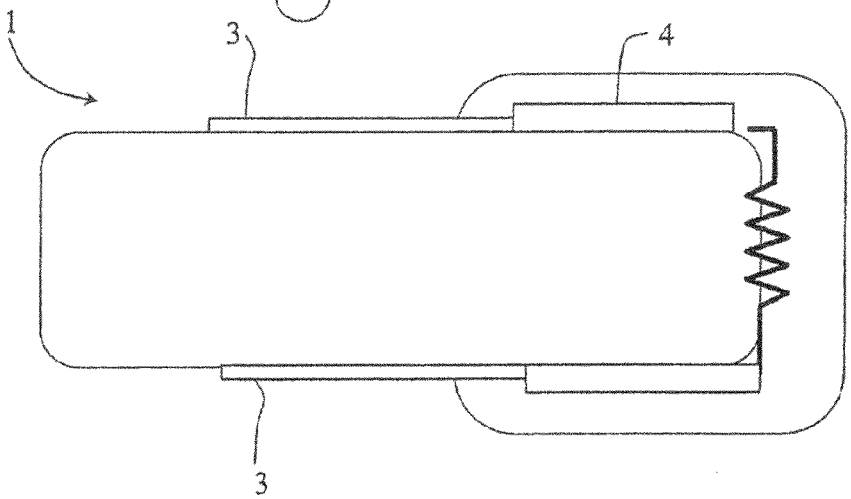
FIG. 3 is a diagrammatic cross-sectional view.

As shown in FIG. 3, the planar passivation material 4 breaks a link at both planar surfaces between the silver electrode 3 and the edge of the disc to break the resistive path between the electrodes. This diagram shows diagrammatically a resistive link, on the disc edge.

EXAMPLE

A ceramic disc body may be produced by sintering in the conventional manner. The ceramic material is mainly ZnO, with Bismuth, Antimony and other oxides required to achieve the electrical performance for a conventional MOV disc. The ceramic body dimensions may be 20.5 mm in diameter with a ~2 mm thickness. Electrodes may be fired onto the surfaces as follows, a silver paste material which contains binders and solvents and glass frit suitable to the printing process and the subsequent firing cycle is printed in a given pattern onto each flat side of the disc. This may then be subjected to a firing process with peak temperatures of 600-800° C. for a total time of 1.5-8 hours. This silver electrode may be approximately 19 mm in diameter and so leaves a ring of exposed ceramic on each of the flat surfaces with a dimension in the radial direction of approximately 0.75 mm. The thickness of this silver material may be in the range of 4-18 μm. The exposed planar surfaces (i.e. the areas of the flat surface not covered by the silver material) may be passivated as follows: the units may be loaded into similar nest plates as those used for the silver printing operation. A passivation material, of glass paste with appropriate binders and solvents may be printed in an annular pattern which may be determined by the screen pattern. The annular pattern may be aligned with the silver electrode print such that the passivation material covers mostly the exposed MOV surface between the silver electrode and the edge of the disc.

This disc may then be assembled with two terminals and over-moulded with a nylon (encapsulant) material to produce a finished device.

The finished varistor device may be tested as follows. Devices may be subjected to an accelerated life test with 125° C. ambient temperature and continuous rated DC voltage applied for 1000 hours. The nominal varistor voltage (measured at 1 mAdc) may be monitored at various time intervals. For MOV devices a definition of a failure is an MOV whose nominal varistor voltage varies by more than +/−10% during this test.

Table 1 below shows an example summary of the results from this test, showing the impact of having no passivation material present.

TABLE 1

Summary of number of failures following Accelerated Life Test.

| Mould Material | | % Fails | Ave Shift 1 mA | |
|---|---|---|---|---|
| Nylon | Pass 1 | 0 | 2.5 | Glass 1 |
| | Pass 2 | 0 | 2.4 | Glass 2 |
| | Pass 3 | 0 | 0.1 | Silicone |
| | None | 50 | 10.9 | None |

Figure 4:
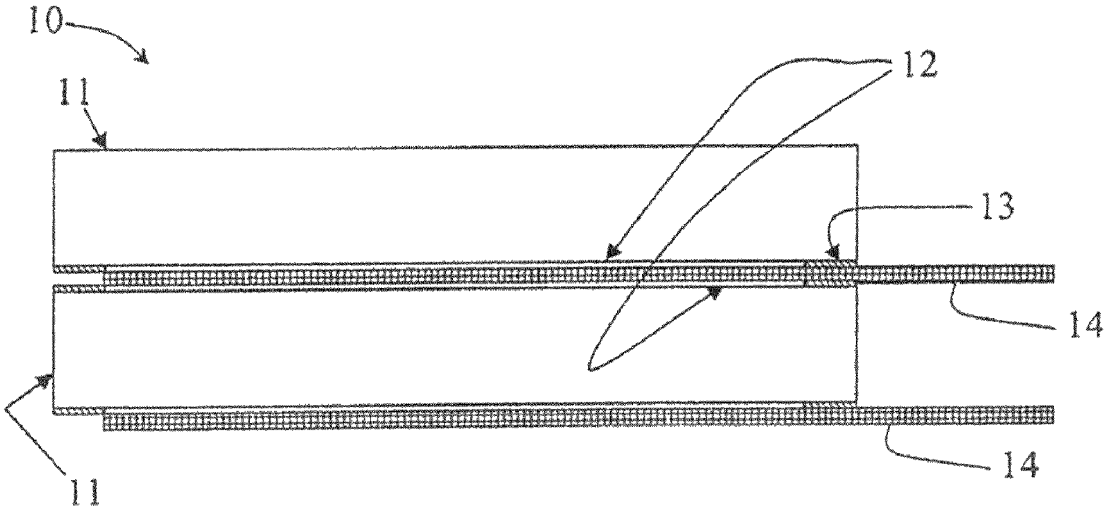
FIG. 4 is a diagrammatic cross-sectional view of a stack of discs.

Referring to FIG. 4, in another embodiment, in building a stack of devices there is a potential problem whereby the terminal between the elements may rest on the MOV surface at the edge of the unit. Given the conventional soldering assembly process there may also be a layer of flux material at this point. It has been found that this can lead to an electrical failure whereby there is a conduction path formed from the edge of the MOV surface, where the terminal is in contact, along the outside edge of the MOV element to the opposing terminal. This failure has been found to occur under electrical stress testing. FIG. 4 illustrates a stack 10 of MOV elements 11 having electrodes 12 and the passivation material 13 is applied to each element 11. This ensures that terminals 14 are not in direct contact with the MOV surface and also reduces the possibility for the flux material to "flow" to the edge of the unit.

The disclosed system is not limited to the embodiments described but may be varied in construction and detail. For example the passivation material may alternatively comprise a silicone or clay material.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A varistor comprising:

a disc body of ceramic material and electrodes having a first thickness and disposed on opposed faces of the body;

encapsulant surrounding the disc and electrodes; and a passivation material having a second thickness about equal to the first thickness, disposed on the body and configured in a band adjoining at least one of the electrodes, the passivation material not extending from one electrode to the other.

2. The varistor of claim 1, wherein the band is on at least one of the opposed body faces.

3. The varistor of claim 1, wherein the passivation material is at least one of: glass paste and printable.

4. The varistor of claim 1, wherein the body is at least one of: a disk, supportable during printing in at least one nest plate, and stackable with at least one other disk.

5. A varistor comprising:

a body of ceramic having electrodes having a first thickness and disposed on opposed faces of the body;

encapsulant applied to the body and the electrodes; and a passivation material having a second thickness about equal to the first thickness and provided in a band adjoining at least one of the electrodes configured to break a link between the at least one electrode and an edge of the body.

6. The varistor of claim 5, wherein the band is applied to at least one of the opposed faces.

7. A varistor comprising:

a disc body of ceramic material and electrodes, the electrodes having a first thickness and disposed on opposed faces of the disc body;

encapsulant surrounding the disc and electrodes; and a passivation material having a second thickness about equal to the first thickness, disposed on the body and configured in a band adjoining at least one of the electrodes, the passivation material not extending from one electrode to the other wherein the passivation material breaks a link between the at least one electrode and an edge of the disc.

* * * * *